US011685490B2

(12) United States Patent
Peng et al.

(10) Patent No.: US 11,685,490 B2
(45) Date of Patent: Jun. 27, 2023

(54) FISH-LIKE UNDERWATER ROBOT

(71) Applicant: University of Electronic Science and Technology of China, Chengdu (CN)

(72) Inventors: Bei Peng, Chengdu (CN); Dunwen Wei, Chengdu (CN); Jialiang Zhong, Wuwei (CN)

(73) Assignee: University of Electronic Science and Technology of China, Chengdu (CN)

( * ) Notice: Subject to any disclaimer, the term of this patent is extended or adjusted under 35 U.S.C. 154(b) by 221 days.

(21) Appl. No.: 17/326,348

(22) Filed: May 21, 2021

(65) Prior Publication Data

US 2022/0242534 A1 Aug. 4, 2022

(30) Foreign Application Priority Data

Jan. 29, 2021 (CN) ..... 202110130209.X

(51) Int. Cl.
*B63G 8/00* (2006.01)
*B63H 1/36* (2006.01)
*B63H 23/02* (2006.01)

(52) U.S. Cl.
CPC ..... *B63G 8/001* (2013.01); *B63H 1/36* (2013.01); *B63H 23/02* (2013.01); *B63G 2008/002* (2013.01)

(58) Field of Classification Search
CPC .... B63G 8/001; B63G 2008/002; B63G 8/00; B63H 1/36; B63H 23/02
See application file for complete search history.

(56) References Cited

U.S. PATENT DOCUMENTS 3,880,107 A * 4/1975 Miles ..... B63H 16/12 440/14
2021/0276678 A1* 9/2021 Yao ..... B63G 8/001

FOREIGN PATENT DOCUMENTS

CN 108482627 A * 9/2018 ..... B63H 1/36

* cited by examiner

*Primary Examiner* — Stephen P Avila
(74) *Attorney, Agent, or Firm* — Bayramoglu Law Offices LLC

(57) ABSTRACT

A fish-like underwater robot includes a shell, a driving assembly and an integrated tension and swing component. The integrated tension and swing component includes a plurality of tension ropes and tension elements. Every two adjacent tension elements are connected in series through the plurality of tension ropes. The driving assembly and the integrated tension and swing component are disposed inside the shell. The driving assembly is disposed at a head of the shell. The integrated tension and swing component has an end connected to a tail of the shell and an end connected to the driving assembly. When the fish-like underwater robot is used, the driving assembly drives the integrated tension and swing component to swing to generate power for forward movement. A traditional fish-like tail swing structure is replaced with an integrated tension skeleton structure.

7 Claims, 3 Drawing Sheets

FISH-LIKE UNDERWATER ROBOT

CROSS REFERENCE TO THE RELATED APPLICATIONS

This application is based upon and claims priority to Chinese Patent Application No. 202110130209.X, filed on Jan. 29, 2021, the entire contents of which are incorporated herein by reference.

TECHNICAL FIELD

The invention relates to the technical field of bio-robots, and particularly relates to a fish-like underwater robot.

BACKGROUND

Generally, marine vertebrates swing their tail fin leftwards and rightwards or upwards and downwards to gain movement power and swim through the cooperation of the tail fin and other fins. At present, most artificial marine vehicles gain movement power by means of a propeller. Such a driving method has the advantage that great driving power can be provided and the defect that loud noises may be generated. On the contrary, if power is gained by simulating a fish movements, noises can be reduced.

In some other inventive creations of fishtailing, the skeletons of fish are connected typically by spherical pairs, each joint can rotate freely around one spherical pair within a certain range to drive the next skeleton to move, and complicated motions can be completed by a plurality of repeated units; however, the movement relation of the skeletons cannot be determined due to the lack of restraints. To fulfill a desired motion, many motors have to be adopted to drive different skeleton units, which will make the design and layout more complicated and reduce the available space in a bionic fish body.

SUMMARY

The objective of the invention is to provide a fish-like underwater robot which is stable in structure and easy to control.

The embodiments of the invention are implemented through the following technical solution:

A fish-like underwater robot comprises a shell, a driving assembly and an integrated tension and swing component, wherein the integrated tension and swing component comprises a plurality of tension ropes and tension elements, and every two adjacent tension elements are connected in series through the plurality of tension ropes;

The driving assembly and the integrated tension and swing component are disposed inside the shell; the driving assembly is disposed at a head of the shell; and the integrated tension and swing component has an end connected to a tail of the shell and an end connected to the driving assembly.

Furthermore, the tension elements are cross-shaped; a plurality of odd tension elements are located in the same plane; a plane where each of even tension elements is located intersects with the plane where the plurality of odd tension elements are located; and the centers of the plurality of tension elements are located on intersection lines of the planes where the plurality of even tension elements are located and the plane where the plurality of odd tension elements are located.

Furthermore, the tension elements are centrosymmetric; and the plane where each of the even tension elements is located is perpendicular to the plane where the plurality of odd tension elements are located.

Furthermore, the integrated tension and swing component has an end fixedly connected to the tail of the shell and an end hinged to the head of the shell; the driving assembly comprises a driving motor, a gear set and two torsion ropes; two sides of a hinge point of each tension element are connected to the two torsion ropes, respectively; the other end of each of the two torsion ropes is connected to a gear; a plurality of gears of the gear set are engaged with each other; two gears connected to the torsion ropes rotate in opposite directions; and the driving motor is rotatably connected to the gears.

Furthermore, the number of the gears is four, the four gears are linearly distributed, and the torsion ropes are connected to two gears at two ends, respectively.

Furthermore, each torsion rope comprises two ropes which are entwined together, so that the torsion rope is a twin-twisted wire.

Furthermore, the torsion ropes are made of nylon wires, carbon fiber wires or braided wires.

Furthermore, the shell is shaped like a dolphin, and the integrated tension and swing component drives the tail to swing upwards and downwards with respect to the head.

Furthermore, the shell is shaped like a carp, and the integrated tension and swing component drives the tail to swing leftwards and rightwards with respect to the head.

The technical solution of the embodiments of the invention has at least the following advantages and beneficial effects:

When the fish-like underwater robot of the invention is used, the driving assembly drives the integrated tension and swing component to swing to generate power for forward movement. A traditional fish-like tail swing structure is replaced with an integrated tension skeleton structure, so that tail swing can be realized only by properly driving and restraining the first tension element, it is unnecessary to drive each tension element, and thus, the control difficulty is effectively lowered, and the overall size and weight will not be increased.

BRIEF DESCRIPTION OF THE DRAWINGS

To more clearly explain the technical solutions of the embodiments of the invention, drawings involved in the embodiments will be briefly introduced below. It should be understood that the following drawings only illustrate some embodiments of the invention and should not be construed as limitations of the scope of the invention. Those ordinarily skilled in the art can obtain other relevant drawings according to the following ones without creative labor.

Figure 1:
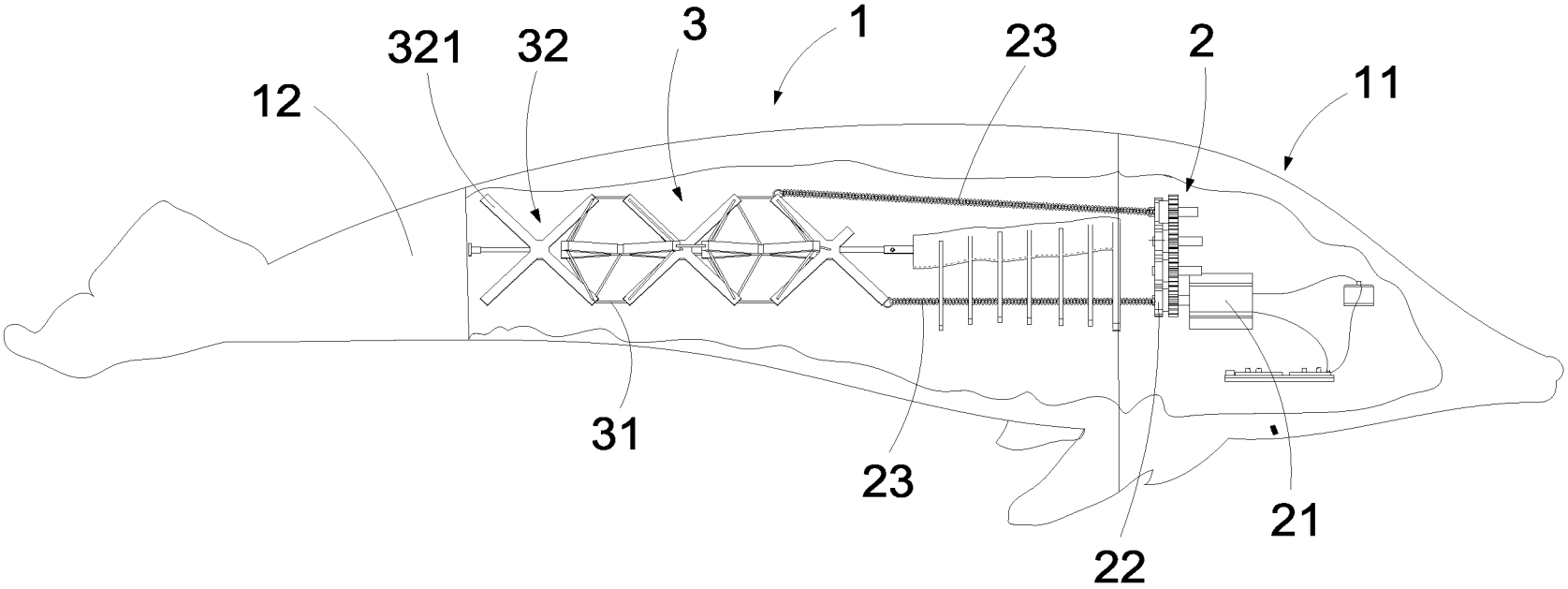
FIG. 1 is a structural diagram of a fish-like underwater robot provided by the invention.
Figure 2:
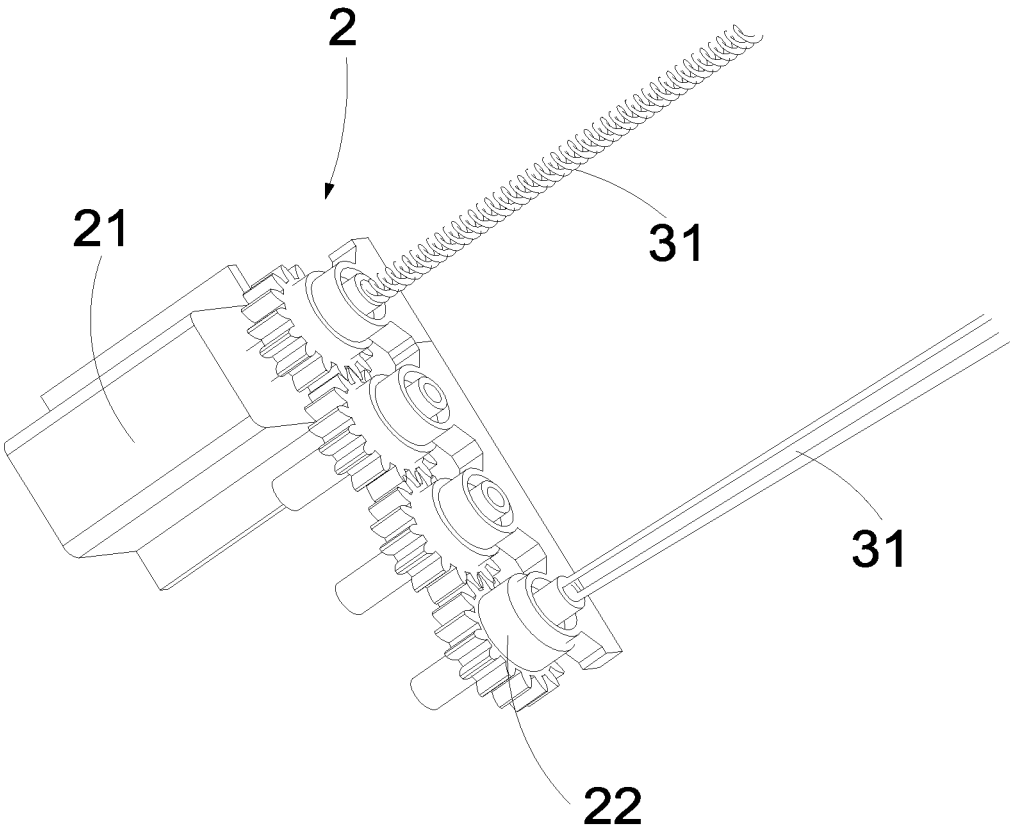
FIG. 2 is a structural diagram of a driving assembly.
Figure 3:
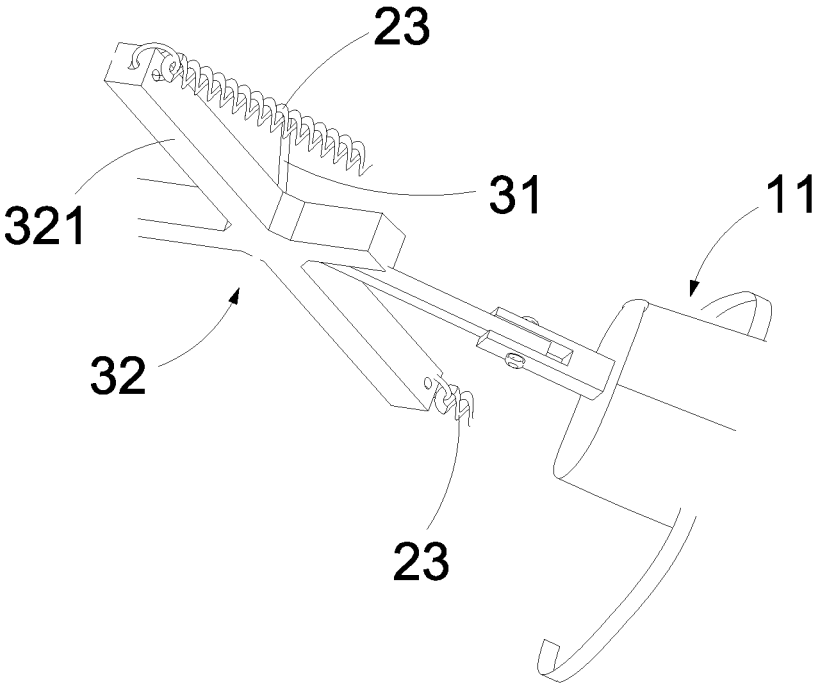
FIG. 3 is a connection diagram of an integrated tension and swing component and a head.

Reference signs: 1, shell; 11, head; 12, tail; 2, driving assembly; 21, driving motor; 22, gear; 23, torsion rope; 3, integrated tension and swing component; 31, tension rope; 32, tension element; 321, branched rod.

DETAILED DESCRIPTION OF THE EMBODIMENTS

Embodiment 1

As shown in FIG. 1-FIG. 4, the invention provides a fish-like underwater robot, which comprises a shell 1, a driving assembly 2 and an integrated tension and swing component 3. The shell 1 is composed of a hollow head 11 and a tail 12. The head 11 and the tail 12 are designed according to the shape of a dolphin, such that the head 11 and the tail 12 are in a shape identical with that of the dolphin after being assembled together. Moreover, the tail 12 is made of a flexible and bendable material, such that the tail 12 can swing under the effect of the integrated tension and swing component 3.

The driving assembly 2 and the integrated tension and swing component 3 are disposed inside the shell 1. The integrated tension and swing component 3 comprises a plurality of tension ropes 31 and tension elements 32. Every two adjacent tension elements 32 are connected in series through the plurality of tension ropes 32. The integrated tension and swing component 3 is located at the waist and the tail 12 of the dolphin and is able to swing to drive the waist and the tail 12 of the dolphin to swing to generate power for forward movement.

The driving assembly 2 is disposed at the head 11 of the shell 1. One end of the integrated tension and swing component 3 is connected to the tail 12 of the shell 1, and the other end of the integrated tension and swing component 3 is connected to the driving assembly 2.

When the fish-like underwater robot of the invention is used, the driving assembly 2 drives the integrated tension and swing component 3 to swing to generate power for forward movement. An integrated tension skeleton structure is used to replace a traditional fish-like tail swing structure, so that tail swing can be realized only by properly driving and restraining the first tension element 32, it is unnecessary to drive each tension element 32, and thus, the control difficulty is effectively lowered, and the overall size and weight will not be increased.

Figure 4:
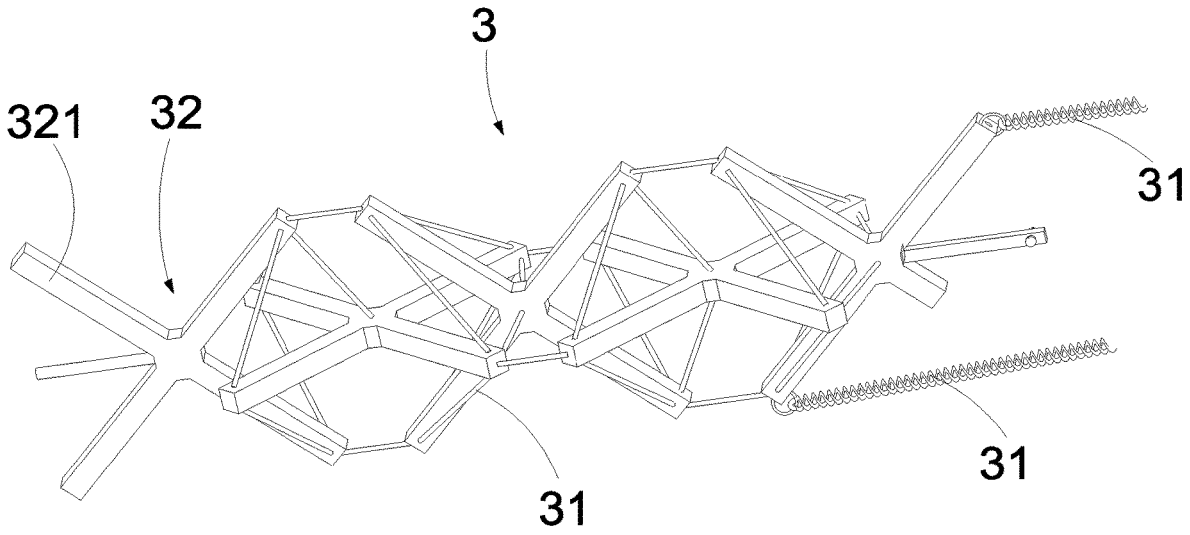
FIG. 4 is a structural diagram of the integrated tension and swing component.

In this embodiment, the tension elements 32 are cross-shaped. As shown in FIG. 4, a plurality of odd tension elements 32 are located in the same plane. A plane where each even tension element 32 is located intersects with the plane where the plurality of odd tension elements 32 are located. The centers of the plurality of tension elements 32 are located on intersection lines of the planes where the plurality of even tension elements 32 are located and the plane where the plurality of odd tension elements 32 are located. Each tension element 32 comprises four branched rods 321, wherein one ends of the four branched rods 321 are connected to the center and are distributed in a cross shape, the other ends, namely the tail ends, of the four branched rods 321 are radially distributed outwards. After the plurality of tension elements 32 are arrayed, the tail ends of three adjacent branched rods 321 are located at the tail end of each branched rod 321, and the three adjacent branched rods are respectively two branched rods 321, located on two side of said branched rod 321, of the tension element 32 adjacent to the tension element 32 where said branched rod 321 is located and one branched rod 321 of the tension element 32 alternate with the tension element 32 where the branched rod 321 is located. The tail end of each branched rod 321 is connected to the tail ends of the three adjacent branched rods 321 through the corresponding tension ropes 31 and is also connected to the center of the tension element 32 adjacent to the tension element 32 where the branched rod 321 is located through one tension rope 31. In this way, the plurality of tension elements 32 are connected into an organic whole.

The plurality of odd tension elements 32 are used for restraining the integrated tension and swing component 3 from shaking in the vertical direction. The plurality of even tension elements 3 are used for restraining the plurality of tension elements 32 from shaking in the horizontal direction, such that a stabilization effect is realized. The stability of the integrated tension and swing component 3 is guaranteed through the cooperation of the plurality of odd tension elements 32 and the plurality of even tension elements.

The tension elements 32 are centrosymmetric. The plane where each even tension element 32 is located is perpendicular to the plane where the plurality of odd tension elements 32 are located, such that the structure of the integrated tension and swing component 3 is more stable and reliable.

In this embodiment, one end of the integrated tension and swing component 3 is connected to the tail 12 of the shell 1, and the other end of the integrated tension and swing component 3 is hinged to the head 11 of the shell 1. The driving assembly 2 comprises a driving motor 21, a gear 22 set and two tension ropes 23. The driving motor 21 is a DC brushless motor or a DC brush motor. Each of two sides of the hinge joint of each tension element 32 is connected to one torsion rope 23. The other end of each of the two torsion ropes 23 is connected to a gear 23. A plurality of gears 22 of the gear 22 set are engaged with each other. The two gears 22 connected to the torsion ropes 23 rotate in opposite directions. The driving motor 21 is connected to the gears 22 and drives the gears 22.

When the tail does not swing, the two torsion ropes 23 are distorted to different degrees. When the circuit is closed, the driving motor 21 starts to rotate, one torsion rope 23 is relaxed and becomes longer gradually, and the other torsion rope 23 is further distorted and becomes shorter, such that a pulling force is generated in the direction of the torsion ropes 23 to pull the integrated tension and swing component 3 to rotate around the hinge point, and then the fishtail at the tail end of the integrated tension and swing component 3 swings, accordingly; and when the swing angle reaches a set value, the motor starts to rotate in an opposite direction, the two torsion ropes 23 turn into states opposite to those in the previous stage, and the fishtail starts to swing in another direction.

In this embodiment, the number of the gears 22 is four. The four gears 22 are linearly distributed. The torsion ropes 23 are connected to the two gears 22 at two ends, respectively. In this way, the two gears 22 connected to the two torsion ropes 23 are far away from each other, and the situation that the two torsion ropes 23 are too close to each other and are worn or wound together is avoided. The number of the gears 22 can be set freely, such as two, as long as the two torsion ropes 23 are kept far away from each other.

In this embodiment, each torsion rope 23 comprises two ropes that are entwined together, such that the torsion rope 23 is a twin-twisted wire. In actual conditions, the torsion ropes 23 are semi-folded ropes.

In this embodiment, the torsion ropes 23 are made of nylon wires, carbon fiber wires, braided wire, or the like.

According to the invention, the integrated tension and swing components 3 can be in different shapes and the number and positions of the driving assemblies 2 can be different to realize different motions. In this embodiment, the integrated tension and swing component 3 formed by the cross-shaped tension elements 32 is used to replace the skeletons of the dolphin. The integrated tension and swing component 3 has many advantages. For example, under the condition where the joint and basic structural form of the integrated tension and swing component 3 are not changed, the shape of the integrated tension and swing component 32 can be properly changed to realize connection of the integrated tension and swing component 32 with other components. In the invention, the driving motor 21 and the integrated tension and swing component 3 are connected by means of this characteristic. Two ends of the tension element 32 closest to the head 11 of the dolphin are each connected to one folded flexible twin-twisted wire, and the other end of the tension element 32 is connected to the gears 22 on two sides. When the driving motor 21 rotates, the two torsion ropes 23 will move in opposite directions at the same speed by means of the drive characteristic of the gears 22, at this moment, one torsion rope 23 will be distorted and become shorter gradually and the other torsion rope 23 will be relaxed and become longer gradually to reach the original length, in this way, the integrated tension and swing component 3 is driven to vertically swing continuously, and the fishtail connected to the tail end of the integrated tension and swing component 3 will swing, accordingly. When the driving motor 21 rotates in the opposite direction, the torsion rope 23 which is distorted and becomes shorter is gradually relaxed, the torsion rope 23 which is relaxed is gradually distorted and becomes shorter, and then the tail 12 of the dolphin is driven to swing in the opposite direction, such that the tail swing motion is completed. The tail swing speed and direction depend on the rotating speed and direction of the driving motor 21, and the tail swing angle depends on the length of the integrated tension and swing component 3 and the maximum length of the torsion ropes 23. The driving motor 21 is a DC brushless motor or a DC brush motor. By using the DC brushless motor or the DC brush motor as the main driving source, system operation is stable, and noises are low.

Embodiment 2

This embodiment is a transformation from Embodiment 1. In this embodiment, the integrated tension and swing component 3 and the driving assembly 2 in Embodiment 1 rotate by 90° in the same direction to change vertical swing of the integrated tension and swing component 3 into horizontal swing. That is, the integrated tension and swing component 3 drives the tail 12 to swing leftwards and rightwards with respect to the head 11. The horizontal swing of the integrated tension and swing component 3 is adapted to fishes that swing their tail leftwards and rightwards, thus being suitable for common fish-like bio-robots. Specifically, the shell 1 may be shaped like a carp or other fishes.

To sum up, by adoption of the above technical solution, the invention has the following beneficial effects:

(1) In the invention, the traditional fish-like tail swing structure is replaced with the integrated tension and swing component 3, so that the tail swing motion can be fulfilled only by properly driving and restraining the first tension element 32, it is unnecessary to drive each tension element 32, and thus, the control difficulty is effectively lowered, and the overall size and weight will be not be increased.

(2) In the invention, the driving motor 21 is a DC brushless motor or a DC brush motor which is used as the main driving source, so that system operation is stable, and noises are low.

(3) In the invention, the trunk is controlled by the twin-twisted wires which are made of nylon wires, carbon fiber wires, braided wires, or other materials with small elastic deformation, the twin-twisted wires made of such materials will become shorter gradually and may even form a circular shape partially when distorted, and can generate an axial force when shortened, and the motor and the gears 22 are fixed, so that the twin-twisted wires can drive the integrated tension skeleton structure and the tail to move.

(4) In the invention, the rotation direction of the two twin-twisted wires can be changed by means of the gear 22 set formed by four external spur gears 22 with completely identical parameters to keep the rotation speed unchanged, so that the two twin-twisted wires can be driven by only one driving motor 21 to move in opposite directions to realize desired functions.

(5) In the invention, the horizontal degree of freedom of the integrated tension and swing component 3 is restrained by means of a proper mechanical structure (hinge) to drive the fish tail to swing in the vertical plane.

The above embodiments are merely preferred ones of the invention, and are not intended to limit the invention. Those ordinarily skilled in the art can make different amendments and variations. Any amendments, equivalent substitutions and improvements made based on the spirit and principle of the invention should also fall within the protection scope of the invention.

What is claimed is:

1. An underwater robot, comprising a shell, a driving assembly, and an integrated tension and swing component, wherein the integrated tension and swing component comprises a plurality of tension ropes and a plurality of tension elements, and two adjacent tension elements of the plurality of tension elements are connected in series through the plurality of tension ropes;

the driving assembly and the integrated tension and swing component are disposed inside the shell;

the driving assembly is disposed at a head of the shell; and the integrated tension and swing component has a first end connected to a tail of the shell and a second end connected to the driving assembly;

wherein the plurality of tension elements are cross-shaped and centrosymmetric;

a plurality of odd tension elements of the plurality of tension elements are located in a first plane;

second planes intersect with the first plane, wherein a plurality of even tension elements of the plurality of tension elements are located in the second planes;

centers of the plurality of tension elements are located on intersection lines of the second planes and the first plane; and the second planes are perpendicular to the first plane.

2. The underwater robot according to claim 1, wherein the integrated tension and swing component has the first end fixedly connected to the tail of the shell and the second end hinged to the head of the shell;

the driving assembly comprises a driving motor, a gear set and two torsion ropes;

two sides of a hinge point of each tension element of the plurality of tension elements are connected to the two torsion ropes, respectively;

an end of each of the two torsion ropes is connected to a gear of the gear set;

a plurality of gears of the gear set are engaged with each other;

two gears of the plurality of gears are connected to the two torsion ropes and rotate in opposite directions; and the driving motor is rotatably connected to the plurality of gears.

3. The underwater robot according to claim 2, wherein a number of the plurality of gears is four, the plurality of gears are linearly distributed, and the two torsion ropes are connected to the two gears at two ends of the gear set, respectively.

4. The underwater robot according to claim 2, wherein each torsion rope of the two torsion ropes comprises two ropes entwined together, and the each torsion rope is a twin-twisted wire.

5. The underwater robot according to claim 2, wherein the two torsion ropes are made of nylon wires, carbon fiber wires or braided wires.

6. The underwater robot according to claim 2, wherein the shell is shaped like a dolphin, and the integrated tension and swing component drives the tail to swing upwards and downwards with respect to the head.

7. The underwater robot according to claim 2, wherein the shell is shaped like a carp, and the integrated tension and swing component drives the tail to swing leftwards and rightwards with respect to the head.

* * * * *